US006098928A

United States Patent [19]

Bross et al.

[11] Patent Number: 6,098,928

[45] Date of Patent: Aug. 8, 2000

[54] TUBE CONNECTION, IN PARTICULAR, FOR CONNECTING TWO TUBULAR FUSELAGE PORTIONS OF A MISSILE

[75] Inventors: Dirk Bross; Klaus-Dieter Knapp; Peter G. Fisch, all of Überlingen, Germany

[73] Assignee: Bodenseewerk Geratetechnik GmbH, Uberlingen/Bodensee, Germany

[21] Appl. No.: 09/132,263

[22] Filed: Aug. 11, 1998

[30] Foreign Application Priority Data

Aug. 16, 1997 [DE] Germany ..... 197 35 452

[51] Int. Cl.[7] ..... B64C 1/14

[52] U.S. Cl. ..... 244/131; 244/120

[58] Field of Search ..... 244/131, 120, 244/119

[56] References Cited

U.S. PATENT DOCUMENTS

| | | | |
|---|---|---|---|
| 759,834 | 5/1904 | Steele | 285/18 |
| 2,945,704 | 7/1960 | Korn | 285/18 |
| 3,345,946 | 10/1967 | Johnson et al. | 102/49.4 |
| 3,781,042 | 12/1973 | Estlick | 285/339 |
| 4,556,591 | 12/1985 | Bannink, Jr. | 244/131 |
| 5,884,864 | 3/1999 | Sunne et al. | 244/131 |

FOREIGN PATENT DOCUMENTS

| | | |
|---|---|---|
| 692 866 | 5/1940 | Germany . |
| 1 173 736 | 7/1964 | Germany . |
| 1 500 729 | 6/1969 | Germany . |
| 2025 416 | 4/1972 | Germany . |
| 196 15 716 A1 | 10/1997 | Germany . |
| 106153 | 5/1917 | United Kingdom . |

*Primary Examiner*—J. Woodrow Eldred
*Attorney, Agent, or Firm*—McDermott, Will & Emery

[57] ABSTRACT

A connection is described for connecting two tubular fuselage portions of a missile. The inner diameter of the rim of a first tubular fuselage portion to be connected with a second tubular fuselage portion corresponds to the outer diameter of the rim of the second tubular fuselage portion to be connected to the first tubular fuselage portion, deducting a jointing tolerance, The rims of the tubular fuselage portion to be connected are provided with radial bores to accommodate connection screws, Clamp segments are mounted in the second tubular fuselage portion along the inner circumference thereof. The clamp segments define threaded bores, connection screws being screwed into these threaded bores.

6 Claims, 1 Drawing Sheet

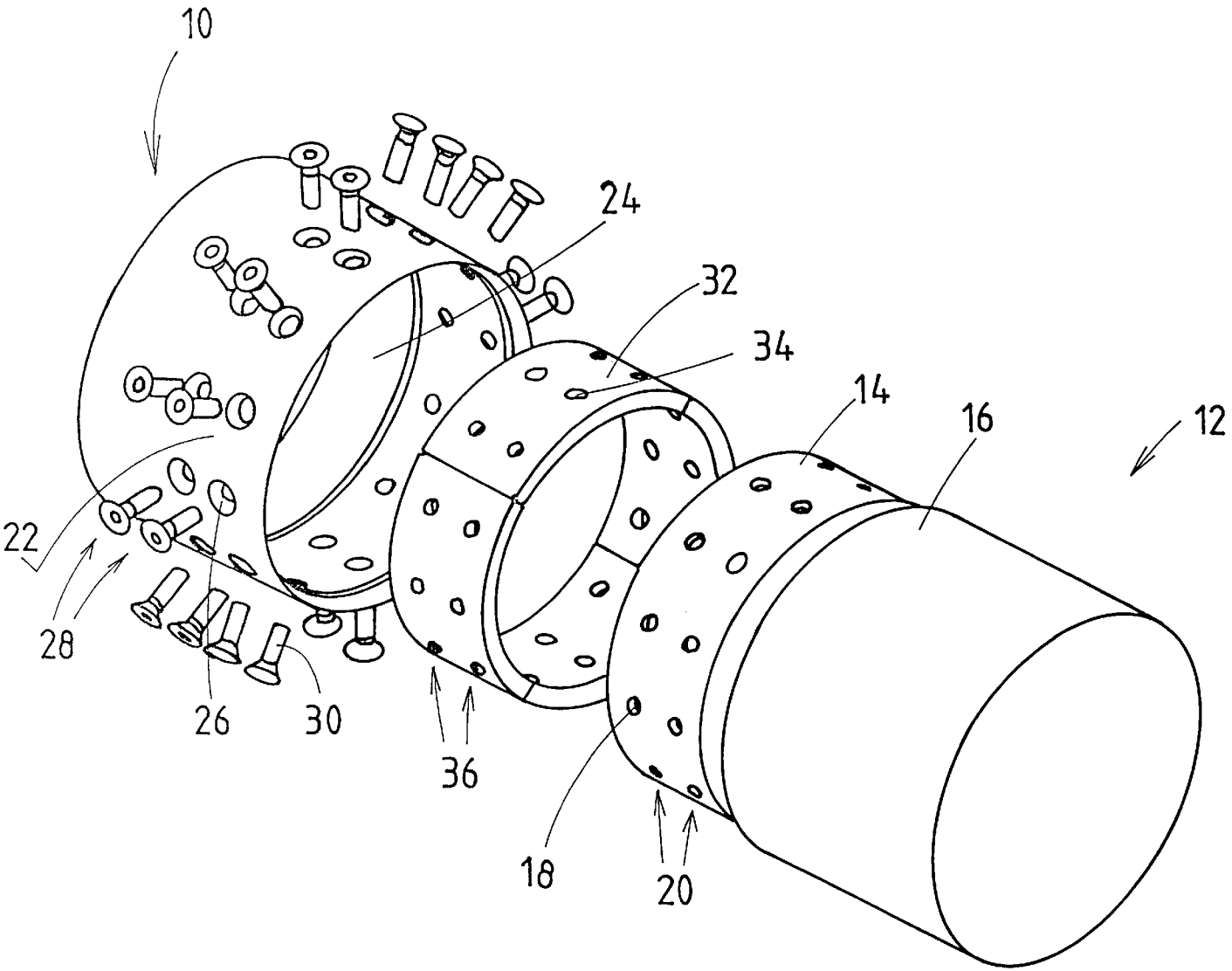
12
16
14
34
32
24
10
20
18
36
30
26
28
22

TUBE CONNECTION, IN PARTICULAR, FOR CONNECTING TWO TUBULAR FUSELAGE PORTIONS OF A MISSILE

TECHNICAL FIELD

The invention relates to a connection for connecting two tubular fuselage portions of a missile with two inter-engaging tubular sections.

PRIOR ART

In prior art tube connections, tube portions which have different diameters in their rim regions to be connected, are pushed into each other and are connected by radial screws. In order to achieve a positive locking the inner tube portion is widened or the outer tube portion is compressed, when tightening the screws. This deformation consumes a large proportion of the screwing force. The positive locking achieved is bad.

The prior art tube connection is not satisfactory, especially when tubular fuselage portions for highly agile missiles are to be interconnected. With such missiles, extreme stresses occur on the tube connections.

From German patent application no. 196 15 7161—not yet published—a tube connection is known in which the rim regions to be connected consists of two circumferential sections of different diameters. The inner diameter of one circumferential section corresponds to the outer diameter of the other circumferential section allowing for the jointing tolerance. The tube portions have identical formations of the rim regions but are rotated about the connection axis by 180°. The tube connection is established by pushing the tube portions into each other and screwing them with radial connection screws or bolts.

The tube connection is provided with an asymmetric radial screw connection and has the advantage that it produces a good positive locking.

DISCLOSURE OF THE INVENTION

It is an object of the invention to provide a highly stable and highly stiff connection for connecting two tubular fuselage portions of a missile.

The connection should be detachable. The connection should permit easy jointing. Costs and manufacturing expenses should be low. The volume of the structural parts should be small. Furthermore, the connection should leave a large free cross-section. Enlargement of the outer diameter by the connection should be avoided. The connection should, furthermore, be free from play.

According to the invention this object is achieved in that (a) the inner diameter of the rim of the first tubular fuselage portion to be connected with the second tubular fuselage portion corresponds to the outer diameter of the rim of the second tubular fuselage portion to be connected to the first tubular fuselage portion, deducting a jointing tolerance, (b) the rims of the tubular fuselage portions to be connected are provided with radial bores to accommodate connection screws, (c) clamp segments are mounted in the second tubular fuselage portion along the inner circumference thereof, the clamp segments define threaded bores, the connection screws being screwed into the threaded bores of the clamp segments, (d) the tube connection defining an outer diameter which is substantially identical with the outer diameters of the tubular fuselage portions.

The clamp segments can be formed as separated circumferential sections of a ring, the outer diameter of which corresponds to the inner diameter of the second tube portion. The screw thread is not provided in the inner tube but in the clamp segments.

Thereby, the screw thread is located in highly stable material as compared to the stressed components. The danger of failure of the internal screw thread no longer exists. Due to the division into several clamp segments, the hoop stress required to overcome widening is heavily reduced.

The connection, furthermore, has a higher stiffness and stability due to a greater carrying portions of the pressing. In the case of two tubes pushed into each other which are screwed directly to each other, i.e. where the internal screw thread is provided in the inner tube, a small barrel-shaped stress region forms around each screw hole. In the case of the invention, this stress region is considerably enlarged as a result of the inner clamp segments.

In a preferred embodiment of the invention, the wall thickness of the connection rim of the second tubular fuselage portion is small. Thereby, and due to the subdivision into several clamp segments, higher stresses can be achieved. This leads to higher endurable working forces before the connection fails.

Modifications of the invention are the subject matter of the dependent claims.

An embodiment of the invention is described in detail hereinafter with reference to the accompanying drawings.

BRIEF DESCRIPTION OF THE DRAWING

The FIGURE shows a perspective view of the connection according to the invention.

EMBODIMENT OF THE INVENTION

Referring to FIG. 1, numeral 10 designates a first tubular fuselage portion. The first tubular fuselage portion 10 is to be connected to a second tubular fuselage portion 12.

The tubular fuselage portions 10 and 12 are the tubular portions of the fuselage of a missile.

The tubular fuselage portion 12 has a rim 14. The rim 14 has a smaller diameter than the remaining portion 16 of the tubular fuselage portion 12. In the rim 14, bores 18 are provided in two rows 20 along the circumference of the rim 14.

The tubular fuselage portion 10 has a rim 22. The rim 22 has an inner diameter which, except for a small jointing tolerance, corresponds to the outer diameter of the rim 14 of the other tubular fuselage portion 12. This inner diameter may be smaller than the inner diameter of the remaining portion 24 of the tubular fuselage portion 10. Bores 26 are provided in the rim 22, in two rows 28 along the circumference of the rim 22. The bores 26 are formed, such that, the head of the screws 30 to be stuck into the bores are countersunk.

Clamp segments 32 are provided for the connection of the two tubular fuselage portions 10 and 12. In the present embodiment, the jointing clamp segments 32 form a ring. This ring has an outer diameter which corresponds to the inner diameter of the rim 14 of the tubular fuselage portion 12.

Bores 34 are provided in the clamp segments 32. The bores 34 are arranged in two rows 36 along the circumference. The bores 34 are provided with inner screw threads which correspond to the screw thread of the connection screws 30. The bores 18 in the rim 14, the bores 26 in the rim 22 and the bores 34 in the clamp segments 32 are mutually arranged such that, they are aligned when the tubular fuselage portions 10 and 12 are pushed into each other and the clamp segments lie within the rim 14. The connection screws 30 are then screwed through the bores 26 and 18 in the screw thread of the bore 34 and into the clamp segments.

What is claimed is:

1. A tube connection for connecting two tubular fuselage portions of a missile, a first tubular fuselage portion having an inner and an outer diameter, an inner and outer circumference and a rim, a second tubular fuselage portion having an inner and an outer diameter, an inner and an outer circumference and a rim adjacent said rim of said first tubular fuselage portion, said outer diameters of said first and second tubular fuselage portions being substantially identical and said two tubular fuselage portions being adapted to be pushed into each other, wherein a) said inner diameter of said rim of said first tubular fuselage portion to be connected with said second tubular fuselage portion corresponds to said outer diameter of said rim of said second tubular fuselage portion to be connected to said first tubular fuselage portion, deducting a jointing tolerance, b) said rims of said tubular fuselage portions to be connected are provided with radial bores to accommodate connection screws, c) clamp segments are mounted in said second tubular fuselage portion along said inner circumference thereof, said clamp segments defining threaded bores, said connection screws being screwed into said threaded bores of said clamp segments, d) said tube connection defines an outer diameter which is substantially identical with said outer diameters of said tubular fuselage portions;

e) a plurality of connection screws are screwed into each of said clamp segments; and f) said clamp segments form a ring of circumferential sections separated from each other, said ring defining an outer diameter which corresponds to said inner diameter of said second tubular fuselage portion.

2. A tube connection for connecting two tubular fuselage portions of a missile, a first tubular fuselage portion having an inner and an outer diameter, an inner and outer circumference and a rim, a second tubular fuselage portion having an inner and an outer diameter, an inner and an outer circumference and a rim adjacent said rim of said first tubular fuselage portion, said outer diameters of said first and second tubular fuselage portions being substantially identical and said two tubular fuselage portions being adapted to be pushed into each other, wherein a) said inner diameter of said rim of said first tubular fuselage portion to be connected with said second tubular fuselage portion corresponds to said outer diameter of said rim of said second tubular fuselage portion to be connected to said first tubular fuselage portion, deducting a jointing tolerance.

b) said rims of said tubular fuselage portions to be connected are provided with radial bores to accommodate connection screws, c) clamp segments are mounted in said second tubular fuselage portion along said inner circumference thereof, said clamp segments defining threaded bores, said connection screws being screwed into said threaded bores of said clamp segments, d) said tube connection defines an outer diameter which is substantially identical with said outer diameters of said tubular fuselage portions; and said connection screws are arranged in two rows along the circumference of said rim of said first tubular fuselage portion.

3. A connection as claimed in claim 1, wherein said rim of said second tubular fuselage portion has a wall thickness which is smaller than the wall thickness of the remainder of said tubular fuselage portion.

4. A connection as claimed in claim 1, wherein said wall thickness of said rim of said second tubular fuselage portion is smaller than the wall thickness of said rim of said first tubular fuselage portion.

5. A tube connection as claimed in claim 1, wherein said connection screws have heads, said heads of said connection screws being countersunk in said rim of said first tubular fuselage portion.

6. A connection as claimed in claim 1, wherein said clamp segments consists of highly stable material.

* * * * *